US008393155B2

(12) United States Patent
Piper et al.

(10) Patent No.: US 8,393,155 B2
(45) Date of Patent: Mar. 12, 2013

(54) GAS TURBINE FUEL INJECTOR WITH INSULATING AIR SHROUD

(75) Inventors: James Scott Piper, El Cajon, CA (US); Hongyu Wang, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 1167 days.

(21) Appl. No.: 11/987,251

(22) Filed: Nov. 28, 2007

(65) Prior Publication Data

US 2009/0133402 A1 May 28, 2009

(51) Int. Cl.
*F02C 1/00* (2006.01)
*F02G 3/00* (2006.01)

(52) U.S. Cl. ..... 60/740; 60/742; 60/739; 60/748

(58) Field of Classification Search ..... 60/740, 60/742, 748, 739
See application file for complete search history.

(56) References Cited

U.S. PATENT DOCUMENTS

| | | | | |
|---|---|---|---|---|
| 2,264,914 | A * | 12/1941 | Orange | 239/132.5 |
| 2,425,229 | A | 8/1947 | Bremser | |
| 3,398,895 | A | 8/1968 | Claffey | |
| 4,229,944 | A | 10/1980 | Weiler | |
| 5,570,580 | A | 11/1996 | Mains | |
| 5,598,696 | A | 2/1997 | Stotts | |
| 6,003,781 | A | 12/1999 | Kwan | |
| 6,149,075 | A | 11/2000 | Moertle et al. | |
| 6,357,222 | B1 | 3/2002 | Schilling et al. | |
| 6,595,000 | B2 | 7/2003 | Lavie et al. | |
| 6,698,207 | B1 | 3/2004 | Wiebe et al. | |
| 6,761,035 | B1 | 7/2004 | Mueller | |
| 6,862,888 | B2 | 3/2005 | Akagi et al. | |
| 6,898,926 | B2 | 5/2005 | Mancini | |
| 6,915,638 | B2 | 7/2005 | Runkle et al. | |
| 7,024,861 | B2 * | 4/2006 | Martling | 60/737 |
| 7,117,675 | B2 | 10/2006 | Kaplan et al. | |

FOREIGN PATENT DOCUMENTS

GB 2280022 A 1/1995

OTHER PUBLICATIONS

Official Action in corresponding Application No. 2008147000 from the Patent Office of the Russian Federation, mailed on Sep. 14, 2012 (9 pages).

* cited by examiner

*Primary Examiner* — William H Rodriguez
*Assistant Examiner* — Craig Kim
(74) *Attorney, Agent, or Firm* — Finnegan, Henderson, Farabow, Garrett & Dunner LLP

(57) ABSTRACT

A fuel injector for a gas turbine engine is disclosed. The fuel injector includes an injector housing extending from a first end to a second end along a longitudinal axis. The second end of the housing is fluidly coupled to a combustor of the turbine engine and the housing includes a liquid fuel gallery annularly disposed about the longitudinal axis. The fuel injector also includes a stem extending longitudinally from the first end of the housing to a third end. The stem includes a liquid tube configured to deliver liquid fuel to the fuel injector. The fuel injector also includes an annular shell extending along the longitudinal axis from the first end to the third end and circumferentially disposed about the stem. The fuel injector further includes an insulating air shroud formed inside the shell. The air shroud includes a layer of air between the shell and the stem.

19 Claims, 5 Drawing Sheets

GAS TURBINE FUEL INJECTOR WITH INSULATING AIR SHROUD

TECHNICAL FIELD

The present disclosure relates generally to a fuel injector for a gas turbine engine, and more particularly, to a gas turbine fuel injector with an insulating air shroud.

BACKGROUND

Gas turbine engines produce power by extracting energy from a flow of hot gas produced by combustion of fuel in a stream of compressed air. In general, turbine engines have an upstream air compressor coupled to a downstream turbine with a combustion chamber ("combustor") in between. Energy is released when a mixture of compressed air and fuel is ignited in the combustor. The resulting hot gases are directed over blades of the turbine, spinning the turbine, thereby, producing mechanical power. In typical turbine engines, one or more fuel injectors direct some type of liquid or gaseous hydrocarbon fuel (such, diesel fuel or natural gas) into the combustor for combustion. Some embodiments of fuel injectors are designed to direct both a liquid and a gaseous fuel into the combustor. In these embodiments, the turbine engine may operate on one fuel as the primary fuel with the other fuel used during periods of unavailability of the primary fuel. For example, some gas turbine engines may normally operate on natural gas fuel. In these turbine engines, diesel fuel may be used during-periods of natural gas unavailability. The fuel is mixed with compressed air (from the air compressor), in the fuel injector, and delivered to the combustor for combustion. This compressed air, which may exceed 800° F. (426.7° C.) in temperature, may surround sections of the fuel injector, and may create a hot ambient environment for the fuel injector. Combustion of the fuel in the combustor creates hot gases exceeding 2000° F. (1093.3° C.), which may heat surrounding surfaces. The heat released due to combustion may also heat fuel injectors, which may be coupled to the combustor.

Fuel injectors include fuel lines and fuel galleries that are used to direct the fuel to the fuel injector and deliver the fuel to the combustor. In a fuel injector that is configured to deliver both liquid and gaseous fuel to combustor, separate fuel lines may deliver the liquid and gaseous fuel to the fuel injector. When the turbine engine operates on gaseous fuel, the liquid fuel may remain in the fuel lines and galleries. In some embodiments, the liquid fuel may be purged from the liquid fuel lines and galleries. However, even in these embodiments, the liquid fuel may exist as a coating on these purged lines and galleries. Due to operating conditions of the fuel injector, the liquid fuel in the liquid fuel lines and galleries may be exposed to ambient temperatures of about 500° F.-800° F. (260° C.-426.7° C.) and injector surface temperatures of 1100° F.-2000° F. (537.8° C.-1093.3° C.). This high temperature may lead to coking of the liquid fuel in the lines and galleries. Over time, the coke may deposit on the lines and galleries and lead to flow restrictions and inoperable conditions.

U.S. Pat. No. 7,117,675 ('675 patent), a patent issued to Kaplan et al. on Oct. 10, 2006, describes a cooling system for gas turbine liquid fuel components to prevent coking. In the system of the '675 patent, a sleeve surrounds a liquid fuel component and a device is used to provide a current of cool air through a space between the liquid fuel component and the sleeve. In the cooling system of the '675 patent the sleeve surrounding the liquid fuel component includes a plurality of spacers for centering the sleeve around the liquid fuel component to create an annulus between the sleeve and the liquid fuel component, through which the current of cool air flows. The current of cool air that is used to cool the liquid fuel component is directed to the annular space using a conduit connected between the cool air device and the sleeve. Although the cooling system of the '675 patent may prevent coking of the liquid fuel within the liquid fuel component, it may have some drawbacks. For instance, using a cool air device to blow cool air around the liquid fuel component may increase the complexity and cost of operating the turbine engine. In addition using individual sleeves to provide an annular space around each liquid fuel component may introduce design complexities when space is limited.

SUMMARY

In one aspect, a fuel injector for a gas turbine engine is disclosed. The fuel injector includes an injector housing extending from a first end to a second end along a longitudinal axis. The second end of the housing is fluidly coupled to a combustor of the turbine engine and the housing includes a liquid fuel gallery annularly disposed about the longitudinal axis. The fuel injector also includes a stem extending longitudinally from the first end of the housing to a third end. The stem includes a liquid tube configured to deliver liquid fuel to the fuel injector. The fuel injector also includes an annular shell extending along the longitudinal axis from the first end to the third end and circumferentially disposed about the stem. The fuel injector further includes an insulating air shroud formed inside the shell. The air shroud includes a layer of air between the shell and the stem.

In another aspect, a method of operating a gas turbine engine is disclosed. The method includes delivering liquid fuel to a combustor of the turbine engine through one or more liquid fuel carrying components of a fuel injector coupled to the combustor, and combusting the liquid fuel in the combustor. The method also includes providing an insulating air shroud around one or more of the liquid fuel carrying components, and generating eddy air currents in the insulating air shroud in response to the combustion. The eddy air currents expel heated air from the insulating air shroud and draw cooler air into the insulating air shroud. The method further includes maintaining a temperature of the one or more liquid fuel carrying components below a threshold temperature as a result of the generation of the eddy air currents.

In yet another aspect, a method of assembling a fuel injector to a gas turbine engine is disclosed. The method includes fluidly coupling a second end of an injector housing to a combustor of the turbine engine. The housing extends from a first end to the second end along a longitudinal axis and the housing includes a stem that extends longitudinally from the first end to a third end. The stem includes a liquid tube configured to deliver liquid fuel to the fuel injector. The method also includes coupling an annular shell to the housing at the first end. The shell extends along the longitudinal axis from the first end to the third end and is circumferentially disposed about the stem to form an insulating air shroud inside the shell. The air shroud includes a layer of air between the shell and the stem. The method further includes coupling the annular shell to an outer casing of the turbine engine at the third end to form a compressed air space in an area outside the shell. The shell prevents flow of air between the compressed air space and the air shroud.

DETAILED DESCRIPTION

Figure 1:
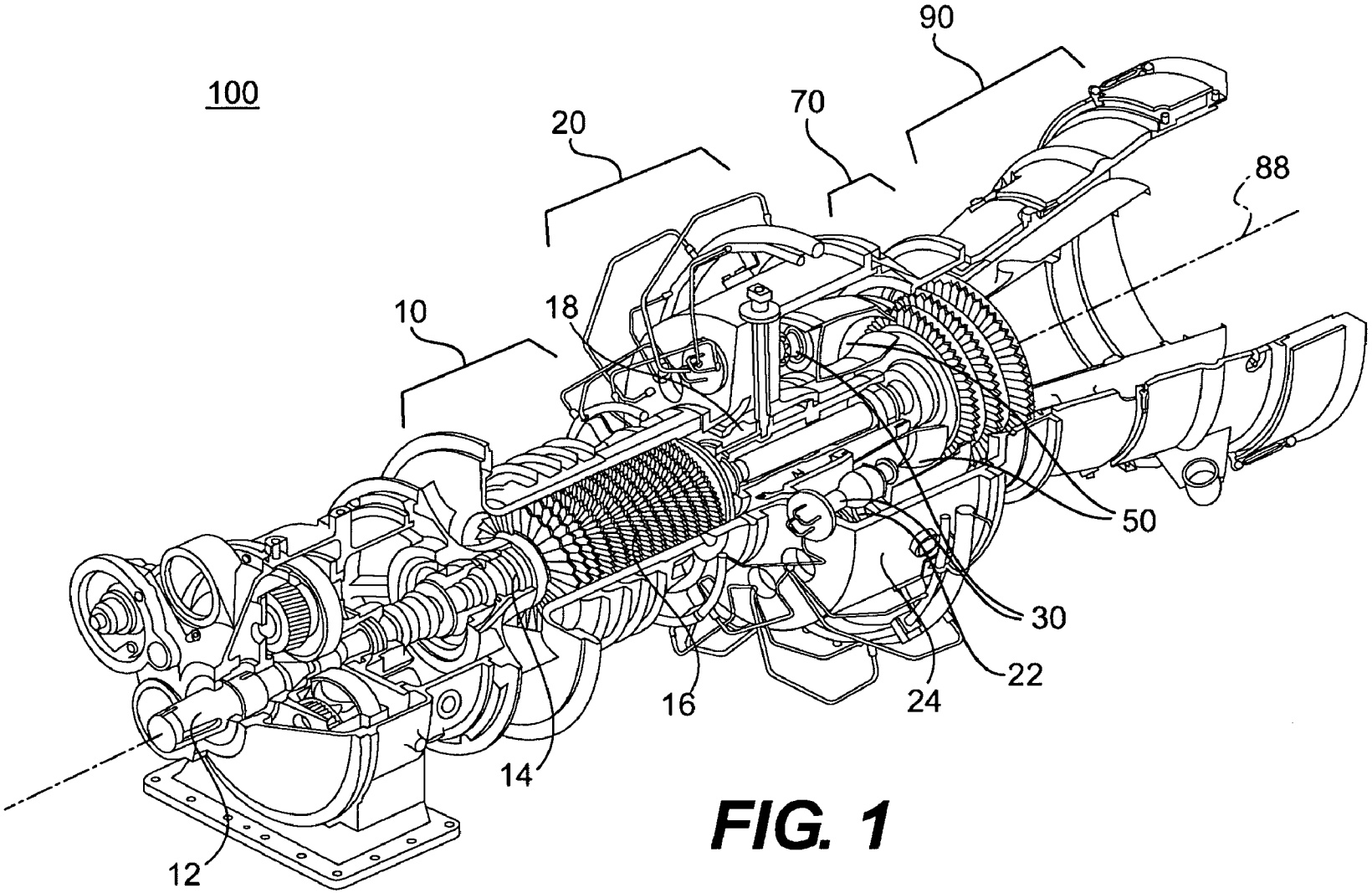
FIG. 1 is an illustration of an exemplary disclosed gas turbine engine system.

FIG. 1 illustrates an cut away view of an exemplary gas turbine engine (turbine engine) 100. Turbine engine 100 may have, among other systems, a compressor system 10, a combustor system 20, a turbine system 70, and an exhaust system 90. In general, compressor system 10 may compress incoming air to a high pressure, combustor system 20 may mix the compressed air with a fuel and burn the mixture to produce high-pressure, high-velocity gas, and turbine system 70 may extract energy from the high-pressure, high-velocity gas flowing from the combustor system 20.

Compressor system 10 may include any device capable of compressing air. In some embodiments this may include an axial flow compressor that produces a continuous flow of compressed air. The axial flow compressor may include rotating and stationary components that cooperate to compress air to the required pressure. A central shaft 12, disposed concentrically about a longitudinal axis 88, may drive a central drum 14 of compressor system 10. The central drum 14 may have a number of annular aerofoils 16 attached thereon in rows along longitudinal axis 88. These aerofoils 16 may rotate between similar rows of stationary aerofoils 16 attached to a stationary tubular casing of compressor system 10. Typically, the rotating aerofoils 16 are called "rotors" and the stationary aerofoils 16 are called "stators." Atmospheric air may enter compressor system 10, and pass through these aerofoils 16. As the air flows through aerofoils 16, the air may get compressed and air pressure may increase. Along with increased pressure, the compressed air exiting aerofoils 16 may have a high temperature. The high pressure and high temperature air may exit compressor system 10 through an outlet port 18. A pair of rotating and stationary aerofoils is called a stage. In general, the pressure and temperature of air exiting outlet port 18 may depend, among others, on the number of stages of compressor system 10. In some embodiments, the pressure and temperature of air exiting compressor system 10 may exceed 200 psi and 800° F. (426.7° C.) respectively.

Combustor system 20 may be connected to outlet port 18 of compressor system 10. Combustor system 20 may include an annular combustor 50 disposed about longitudinal axis 88. In some embodiments, combustor system 20 may include multiple substantially cylindrical combustors (called can-type combustors) arranged in a circular array pattern about longitudinal axis 88. In some embodiments, combustor system 20 may include combustors that are a hybrid of annular and can-type combustors (combination type combustor). Although an annular combustor 50 is depicted in FIG. 1, the disclosed fuel injector with an insulating shroud may be applicable with any type of combustor. Outlet port 18 of compressor system 10 may deliver compressed air into an enclosure 22 formed by an outer casing 24 around central shaft 12. Compressed air from enclosure 22 may be directed into one or more fuel injectors 30 coupled to combustor 50 and annularly positioned about longitudinal axis 88.

Figure 2:
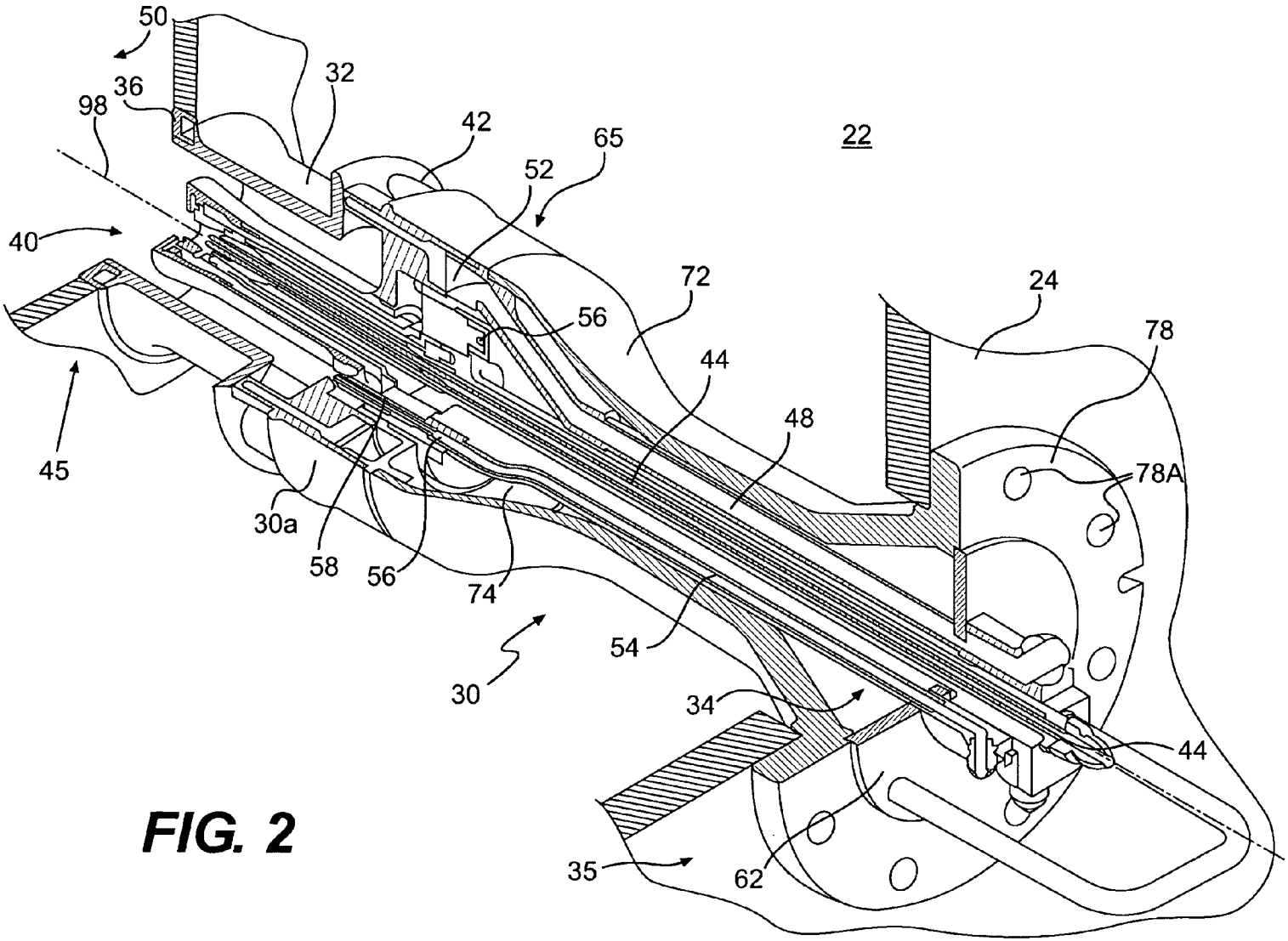
FIG. 2 is a cross-sectional view of a fuel injector of the turbine engine of FIG. 1.

FIG. 2 illustrates a cross-sectional view of a fuel injector 30 coupled to combustor 50. Fuel injector 30 may be positioned in enclosure 22 with a first end 45 coupled to combustor 50 and a second end 35 coupled to outer casing 24. High pressure and high temperature compressed air from compressor system 10 may surround fuel injector 30 in enclosure 22. In some cases, the temperature of compressed air in enclosure 22 may exceed 800° F. (426.7° C.). This high temperature compressed air may heat external surfaces of fuel injector 30.

The compressed air in enclosure 22 may be directed into fuel injector 30 through an air swirler 42. Air swirler 42 may include a plurality of straight or curved blades attached to a housing 30*a* of fuel injector 30 to swirl the incoming compressed air. The number of blades in air swirler 42 may vary with application. Although air swirler 42 of FIG. 2 is illustrated as a radial swirler, air swirler 42 in general, may have a radial or an axial configuration. A radial swirler is an air swirler in which compressed air from compressor system 10 may be directed to the curved blades radially, while an axial swirler is an air swirler in which the compressed air may be directed to the curved blades axially.

A plurality of liquid fuel nozzles 58 attached to housing 30*a* may inject liquid fuel into the swirled air stream from air swirler 42. Although liquid fuel nozzles 58 positioned upstream of air swirler 42 are depicted in FIG. 2, in some embodiments, these liquid fuel nozzles 58 may take the form of small tubes attached to air swirler 42. Fuel injector 30 may also include gas ports (not shown) to deliver the gaseous fuel to combustor 50. In some embodiments, these gas ports may include a plurality of small holes located on air swirler 42. When turbine engine 100 operates using gaseous fuel, fuel gas may be injected into the swirled air stream through these gas ports. Swirling the incoming air into fuel injector 30, using air swirler 42, may help mix the fuel with the compressed air and deliver a premixed mixture of fuel and air to combustor 50. This premixed fuel-air mixture may be delivered to combustor 50 through a premix barrel 32 of fuel injector 30 that may be coupled to combustor 50.

Fuel injector 30 may also include a pilot assembly 40 disposed radially inwards of premix barrel 32. In some embodiments, pilot assembly 40 and premix barrel 32 may be aligned along a second longitudinal axis 98 of fuel injector 30. Pilot assembly 40 may include components configured to inject a stream of pressurized fuel into combustor 50. In embodiments of fuel injector 30 configured to deliver both liquid and gaseous fuel to combustor 50, pilot assembly 40 may be configured to inject a stream of pressurized liquid and gaseous fuel into combustor 50. Pilot assembly 40 may also include components configured to deliver a stream of compressed air along with the pressurized fuel into combustor 50. In addition, swirl features (not shown) may also be located within pilot assembly 40 to swirl the compressed air delivered to pilot assembly 40.

Combustor 50 may include an ignition device (not shown), such as a torch igniter, to ignite the fuel delivered to combustor 50. The premixed fuel-air mixture delivered through premix barrel 32, and the pressurized stream of fuel and air delivered through pilot assembly 40, may ignite in combustor 50 to create combustion flames. Once ignited, a continuous stream of fuel delivered through fuel injector 30 may sustain the combustion flame. An average temperature of the combustion flame may, in some cases, exceed 2000° F. (1093.3° C.). The flame may heat surfaces of combustor 50 and first end 45 of fuel injector 30 proximate the flame. This heat may be transferred to relatively cooler regions of the fuel injector 30 by standard modes of heat transfer (such as, conduction, convection, and radiation). A cooling air flow may be maintained through a space between multiple walls (not shown) of combustor 50 to keep the combustor surfaces at a safe operating temperature.

Fuel injector 30 may include fuel supply conduits that deliver fuel to fuel injector 30. These conduits may form a stem 34 extending longitudinally from second end 35 along second longitudinal axis 98. The stem 34 may include a main gas tube 48, a pilot gas tube, main liquid fuel tube 54, and pilot liquid tube 44. It is contemplated that, in some embodiments, stem 34 may include less than, or more than, these afore mentioned conduits. In some embodiments, stem 34 may extend along second longitudinal axis 98 from second end 35 towards housing 30*a*. Main gas tube 48 may supply gaseous fuel from a gaseous fuel manifold (not shown) to a main gas gallery 52 included in fuel injector housing 30*a*. Main gas gallery 52, annularly positioned around second longitudinal axis 98, may deliver gaseous fuel to the swirled air stream in premix barrel 32. Main gas gallery 52 may also supply gaseous fuel to pilot assembly 40. In some embodiments, a separate pilot gas tube included in stem 34 may supply gaseous fuel to pilot assembly 40.

Liquid fuel tube 54 may supply liquid fuel from a liquid fuel supply (not shown) to a main liquid gallery 56 included in housing 30*a*. Main liquid gallery 56 may include an annular channel around second longitudinal axis 98. Main liquid gallery 56 may be fluidly coupled to liquid fuel nozzle 58 and may deliver liquid fuel to the swirled air stream in premix barrel 32 to create the premixed fuel-air mixture.

Pilot liquid tube 44 may direct liquid fuel from outside fuel injector 30 to pilot assembly 40. Pilot liquid tube 44 may be an elongate assembly extending from second end 35 to first end 45 along second longitudinal axis 98. The liquid fuel delivered to pilot assembly 40 through pilot liquid tube 44 may be sprayed into combustor 50 through a nozzle coupled to first end 45 of pilot liquid tube 44. Compressed air may also be injected into combustor 50 alongside the fuel spray through openings around pilot liquid tube 44. This liquid fuel and compressed air spray may form the pressurized stream of fuel and air delivered to combustor 50 through pilot assembly 40.

Heat transferred from the combustion flame (in combustor 50) and the compressed air (in enclosure 22) to the relatively cooler regions of fuel injector 30 may heat the liquid fuel carrying components of fuel injector 30. The term "liquid fuel carrying components" are generally used to include any component of fuel injector 30 that is configured to deliver liquid fuel to combustor 50. In some embodiments, these liquid fuel carrying components may include liquid fuel tube 54, main liquid gallery 56, liquid fuel nozzle 58, and pilot liquid tube 44. It is contemplated that, in some embodiments, liquid fuel carrying components may include additional liquid fuel carrying components, or less than all the afore mentioned liquid fuel carrying components. It may be desirable to keep the temperature of some (or all) of these liquid fuel carrying components below a threshold temperature during operation of the turbine engine 100. In general, this threshold temperature may be any value of temperature. In some embodiments, the threshold temperature may be about 400° F. (204.4° C.). Maintaining a temperature of the liquid fuel carrying components below about 400° F. (204.4° C.) may prevent coking of the liquid fuel in the liquid fuel carrying components.

Figure 3A:
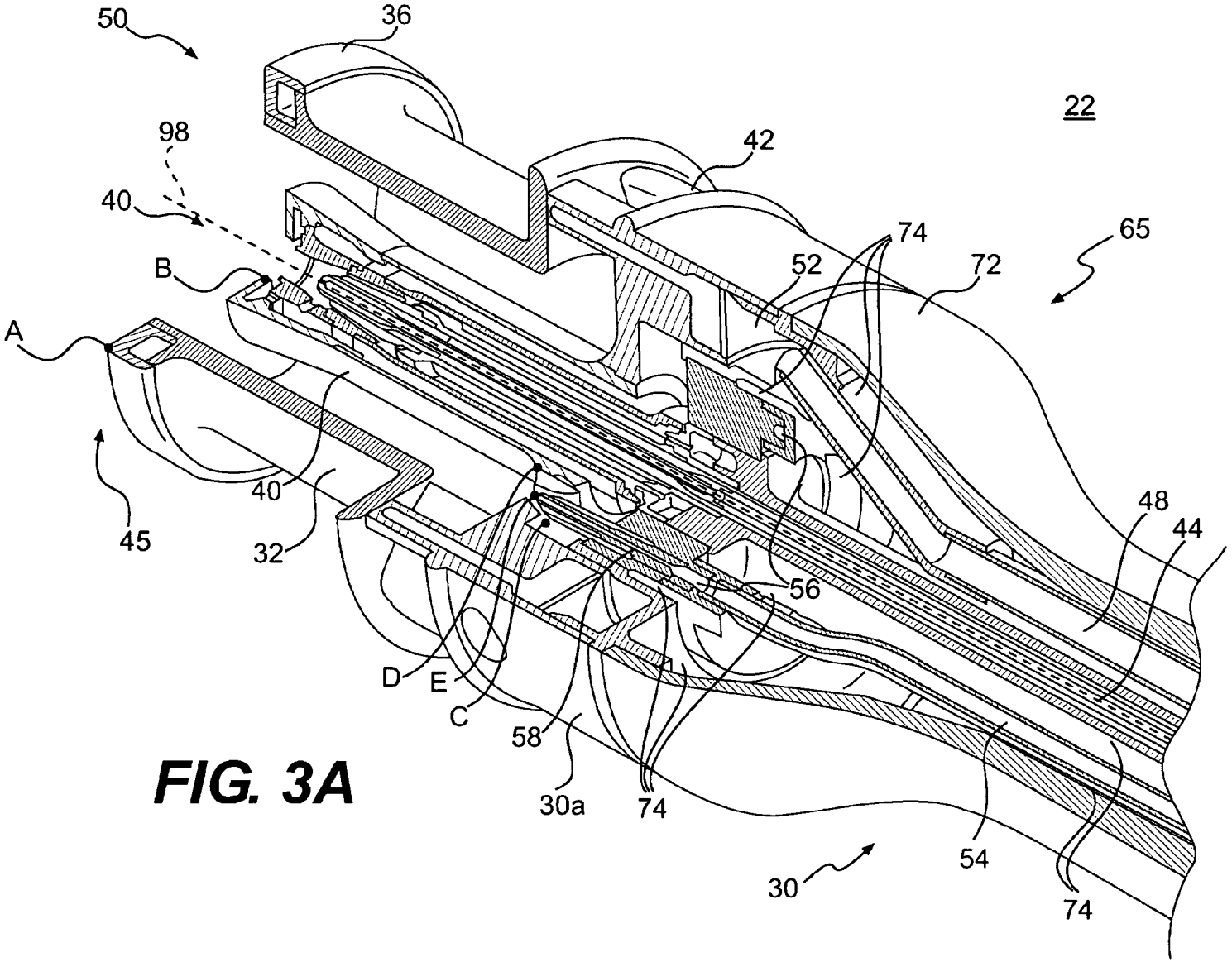
FIGS. 3A and 3B illustrate cross-sectional views of the first end and second end respectively of the fuel injector of FIG. 2.
Figure 3B:
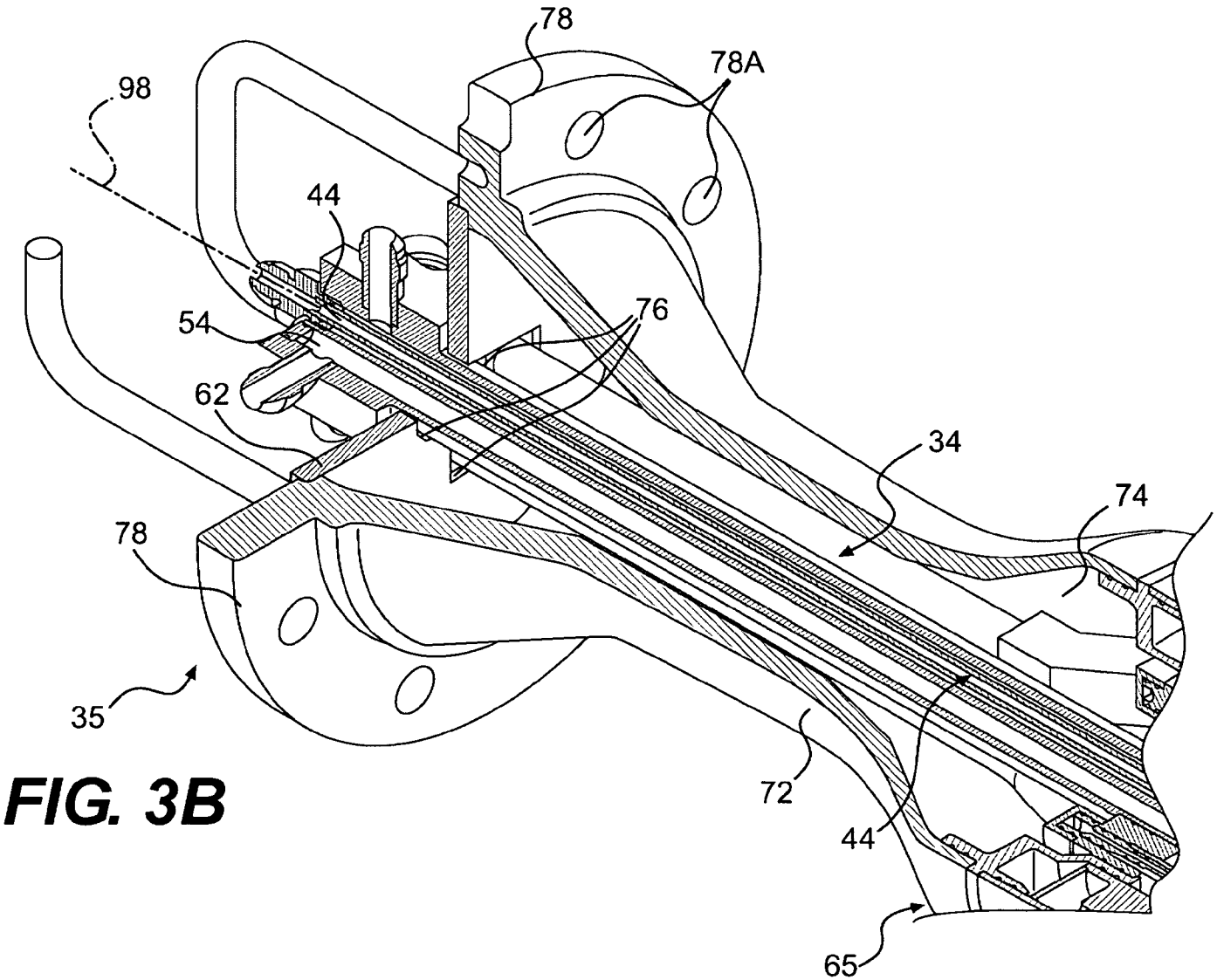

A shell 72 may be coupled to fuel injector 30 to form an insulating air shroud 74 around the liquid fuel carrying components to keep their temperature below about 400° F. (204.4° C.). Shell 72 may extend longitudinally from second end 35 of fuel injector 30 to a third end 65, proximate air swirler 42. Shell 72 may be coupled to housing 30*a* at third end 65 and to a circular disk 62 at second end 35. In some embodiments, shell 72 may be brazed to housing 30*a* at third end 35. However, other methods of coupling shell 72 to housing 30*a* are also contemplated. FIGS. 3A and 3B illustrate sections of fuel injector 30 at third end 65 and second end 35, respectively. In the description that follows, reference will be made to both FIGS. 3A and 3B. Circular disk 62 may be coupled to stem 34 and may include passageways to pass stem 34 there-through. Air gaps 76 (shown in FIG. 3B) may be formed between stem 34 and circular disk 62. These air gaps 76 may vent insulating air shroud 74 to atmosphere outside outer casing 24.

Insulating air shroud 74 may include a space formed between shell 72 and stem 34 of fuel injector 30. Insulating air shroud 74 may include a layer of air that shields the liquid fuel carrying components from the temperature of the combustor 50 and the temperature of the compressed air in enclosure 22. The air in insulating air shroud 74 may get heated by the heat transferred from combustor 50 and enclosure 22. The heated air proximate third end 65 may interact with cooler air towards second end 35. The interaction of heated air with the cooler air may create natural eddy currents within the space. These eddy currents may allow the heated air in the space to escape through air gap 76. These eddy currents may also draw in cooler air atmospheric air (from the atmosphere outside outer casing 24) into insulating air shroud 74 through air gap 76. The eddy currents may keep air in insulating air shroud 74 relatively cool, and maintain the temperature of the liquid fuel carrying components below about 400° F. (204.4° C.).

Figure 4:
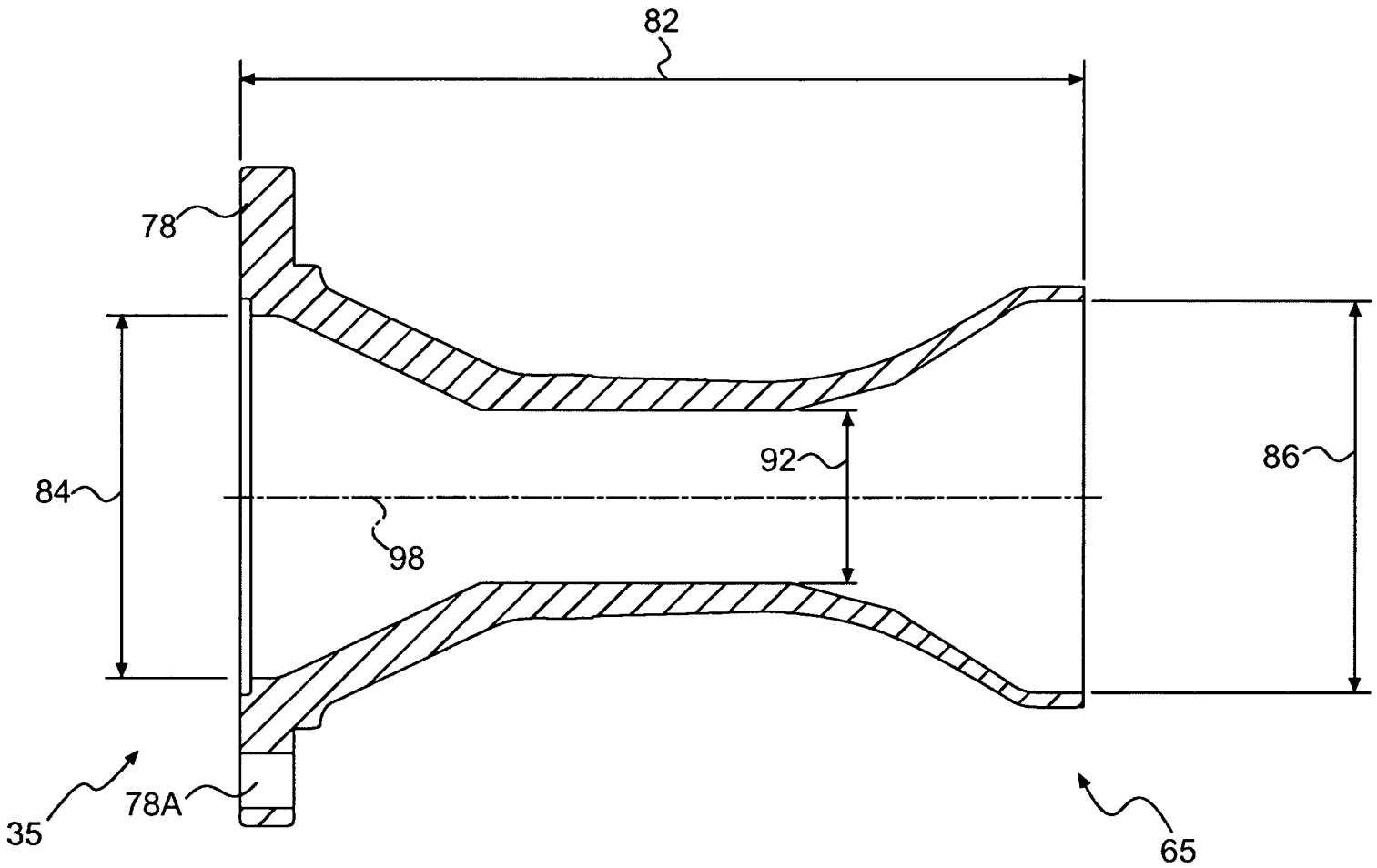
FIG. 4 is an a cross-sectional view of a embodiment of a shell of the fuel injector of FIG. 2.

FIG. 4 illustrates a cross-sectional view of an exemplary shell 72 used in an application. Shell 72 may be made of any material that will survive the temperatures and stresses induced during operation of turbine engine 100. In some embodiments, shell 72 may be made of a stainless steel alloy, such as, for example 316L stainless steel alloy. Shell 72 may enclose substantially all the liquid fuel carrying components within insulating air shroud 74. Although the size and shape of shell 72 may depend upon the application, in some embodiments, shell 72 may have a length 82 between about 9 to 10 inches (22.9 to 25.4 centimeters). Shell 72 may have a generally tubular shape with a first diameter 84 at the second end 35, and a second diameter 86 at third end 65, respectively. At a location between the second end 35 and third end 65, shell 72 may have a third diameter 92 less than first diameter 84 and second diameter 86. Although in general, these diameters may depend upon the application, in some embodiments shell 72 may have first diameter 84 between about 3.5 to 4.5 inches (8.9 to 11.4 centimeters), second diameter between about 4 to 5 inches (10.2 to 12.7 centimeters), and third diameter between about 1.5 to about 2.5 inches (3.8 to 6.4 centimeters). The resulting shape of shell 72 may provide an insulating air shroud 74 where eddy currents may be established to keep a temperature of the liquid fuel carrying components below about 400° F. (204.4° C.) while reducing the overall size of shell 72.

Shell 72 may include a flange section 78 at second end 35 of fuel injector 30. The flange section 78 may extend substantially perpendicularly away from second longitudinal axis 98. In some embodiments, flange section 78 may include fastener holes 78A annularly in a circular array about second longitudinal axis 98. The flange section 78 may be used to couple fuel injector 30 to outer casing 24 of turbine engine 100 (shown in FIG. 2). In some embodiments, fasteners (not shown) passing through fastener holes 78A in flange section 78 may be used to attach fuel injector 30 to outer casing 24. Structural loads from fuel injector 30 may be transferred to outer casing 24 primarily through shell 72. Although, in the exemplary embodiments described herein, insulating air shroud 74 is configured to maintain a temperature of the liquid fuel carrying components below 400° F. (204.4° C.), in general, an insulating air shroud of the current disclosure may be configured to maintain a temperature of any component of a turbine engine fuel injector below any threshold temperature.

INDUSTRIAL APPLICABILITY

The disclosed gas turbine fuel injector with an insulating air shroud may be applicable to any turbine engine where it is desirable to maintain a temperature of selected regions of the fuel injector below a desired temperature. In an embodiment of a fuel injector that is configured to deliver liquid fuel to the turbine engine, an insulating air shroud may be used to maintain the temperature of all or selected liquid fuel carrying components below about 400° F. (204.4° C.), and thereby prevent coking of the liquid fuel. The operation of a gas turbine engine with a fuel injector having liquid fuel carrying components maintained below about 400° F. (204.4° C.) will now be described.

During operation of turbine engine 100, air may be drawn into turbine engine 100 and compressed in compressor system 10 (see FIG. 1). Compression of the air may increase a temperature of the compressed air to about 800° F. (426.7° C.). The compressed air may be directed to an enclosure 22 of the turbine engine 100. The hot compressed air in enclosure 22 may heat a fuel injector 30 located in enclosure 22. The compressed air from enclosure 22 may be directed to a combustor 50 of combustor system 20 through fuel injector 30. Fuel may be mixed with the compressed air as it flows through fuel injector 30 into combustor 50. The fuel-air mixture may burn in combustor 50 producing a temperature of about 2250° F. (1232.2° C.).

A shell 72 may be coupled with fuel injector 30 to shield the liquid fuel carrying components (liquid fuel tube 54, main liquid gallery 56, liquid fuel nozzle 58, and pilot liquid tube 44 of FIG. 2) of fuel injector 30 from the heat of combustion and the hot compressed air in enclosure 22. Shell 72 may couple with housing 30*a* of fuel injector 30 to form an insulating air shroud 74 around the liquid fuel carrying components. The air in the insulating air shroud 74, proximate third end 65, may get heated by the combustion of the fuel-air mixture in combustor. This heated air in the insulating air shroud may interact with cooler air near the second end 35 and set up eddy currents within the insulating air shroud 74. These eddy air currents may expel hot air from the insulating air shroud 74 and draw cooler air into the insulating shroud 74 to maintain the temperature of the liquid fuel components below about 400° F. (204.4° C.).

Creating an insulating air shroud around liquid fuel carrying components of the fuel injector enables the temperature of these components to be maintained below 400° F. (204.4° C.), and thereby prevent coking. Although temperatures of regions in close proximity to the liquid fuel carrying components may be at a significantly higher temperature, the insulating air shroud keeps the liquid fuel components relatively cool. Since cooling of the liquid fuel carrying components occurs due to a natural phenomenon of air within the insulating air shroud (that is, without the aid of external air moving means), the cost associated with preventing coke formation in liquid fuel components of the turbine engine may be low. Additionally, the shell that creates the insulating air shroud may be designed to meet the space requirements of fuel injectors 30.

It will be apparent to those skilled in the art that various modifications and variations can be made to the disclosed fuel injector with insulating air shroud. Other embodiments will be apparent to those skilled in the art from consideration of the specification and practice of the disclosed fuel injector with insulating air shroud. It is intended that the specification and examples be considered as exemplary only, with a true scope being indicated by the following claims and their equivalents.

What is claimed is:

1. A fuel injector for a gas turbine engine comprising:

an injector housing extending from a third end to a first end along a longitudinal axis, the first end of the housing being fluidly coupled to a combustor of the turbine engine and configured to direct compressed air and a liquid fuel to the combustor;

a stem extending longitudinally form the third end of the housing in a direction away from the first end to a second end such that the third end is located between the second end and the first end, the stem including a liquid tube configured to deliver the liquid fuel to the fuel injector;

an annular shell extending along the longitudinal axis from the third end to the second end and circumferentially disposed about the stem;

an insulating air shroud formed inside the shell, the air shroud including a layer of atmospheric air formed in an annular space between the shell and the stem, the annular space (a) being closed at the third end to prevent flow of the atmospheric air in the air shroud to the combustor and (b) including one or more openings at the second end to vent the atmospheric air in the annular space to the atmosphere; and a covering member coupled to the shell and the stem at the second end to at least partially cover the annular space between the shell and the stem at the second end.

2. The fuel injector of claim 1, wherein the covering member is a substantially circular disk and the one or more openings are formed between the stem and the disk.

3. The fuel injector of claim 2, wherein the shell includes a flange at the second end, the flange extending radially outwards of the longitudinal axis.

4. The fuel injector or claim 3, wherein the flange includes a plurality of fastener holes arranged in circular array about the longitudinal axis, the flange being configured to couple to an outer casing of the turbine engine.

5. The fuel injector of claim 1, wherein the shell is configured to couple to an outer casing of the turbine engine to form a compressed air space in an area outside the shell, the compressed air space including the compressed air directed into the combustor through the fuel injector, and the shell substantially preventing a mixing of the compressed air in the compressed air space with the atmospheric air in the air shroud.

6. The fuel injector of claim 2, wherein only the one or more openings between the shell and the stem fluidly communicate the atmospheric air in the air shroud to the atmosphere.

7. The fuel injector of claim 1, wherein the shell has a generally tubular shape having a first diameter at the second end, a second diameter at the third end, and a third diameter between the second and third ends, the third diameter being smaller than the first diameter and the second diameter.

8. The fuel injector of claim 7, wherein a length of the shell between the third end and the second end is between about 9 inches (22.9 centimeters) to about 10 inches (25.4 centimeters).

9. The fuel injector of claim 7, wherein the first diameter is between about 3.5 inches (8.9 centimeters) to 4.5 inches (11.4 centimeters), the second diameter is between about 4 (10.2 centimeters) inches to about 5 inches (12.7 centimeters), and third diameter is between about 1.5 inches (3.8 centimeters) to about 2.5 inches (6.4 centimeters).

10. A method of assembling a fuel injector to a gas turbine engine comprising:

fluidly coupling a first end of an injector housing to a combustor of the turbine engine, the housing extending from a third end to the first end along a longitudinal axis, the housing including a stem extending longitudinally form the third end in direction away from the first end to a second end such that the third end is located between the second end and the first end, the stem including a liquid tube configured to deliver a liquid fuel to the fuel injector;

coupling an annular shell to the housing at the third end, the shell extending along the longitudinal axis from the third end to the second end and being circumferentially disposed about the stem to form an insulating air shroud in an annular space between the shell and the stem, the air shroud being a layer of atmospheric air in the annular space that is adapted to flow into and flow out of the annular space through one or more openings at the second end, the annular space being closed at the third end to prevent flow of the atmospheric air in the air shroud to the combustor; and coupling the annular shell to an outer casing of the turbine engine to form a compressed air space, including compressed air, in an area outside the shell, the shell preventing a mixing of the compressed air in the compressed air space with the atmospheric air in the air shroud.

11. The method of claim 10 further including coupling a circular disk to the shell and the stem at the second end such that the one or more openings are formed between the stem and the disk to vent the atmospheric air in the air shroud to atmosphere.

12. The method of claim 10 further including connecting the liquid tube to a liquid fuel supply of the turbine engine.

13. A fuel injector for a gas turbine engine comprising:

an injector housing extending from a third end to a first end along a longitudinal axis, the first end of the housing configured to be fluidly coupled to a combustor of the turbine engine;

an air swirler positioned in the housing between the third end and the first end, the air swirler being configured to direct compressed air into the fuel injector;

a stem extending longitudinally from the third end of the housing in a direction away from the first end to a second end such that the third end is located between the second end and the first end, the stem including a liquid tube configured to direct a liquid fuel to the combustor through the fuel injector;

an annular shell circumferentially disposed about the stem, and extending from the third end to the second end, to separate an annular space within the shell from a compressed air space outside the shell, the compressed air space being adapted to include the compressed air that is configured to be directed into the fuel injector through the air swirler, and the annular space being configured to include atmospheric air, the annular shell being disposed about the stem such that the annular space is closed at the third end to prevent flow of the atmospheric air in the annular space to the combustor.

14. The fuel injector of claim 13, further including one or more openings that fluidly couple the annular space within the shell to the atmosphere.

15. The fuel injector of claim 14, further including a disk connected between the shell and the stem at the second end, the disk forming the one or more openings between the shell and the stem.

16. The fuel injector of claim 14, wherein the one or more openings are formed at the second end, and the atmospheric air in the annular space is configured to enter and exit the annular space only through the one or more openings.

17. The fuel injector of claim 13, wherein the liquid fuel tube is a first liquid fuel tube, and the stern further includes a second liquid fuel tube that is separate from the first liquid fuel tube.

18. The fuel injector of claim 13, wherein the annular shell is brazed to the housing at the third end.

19. The fuel injector of claim 13, wherein the annular shell is made of stainless steel.

* * * * *